US005432981A

United States Patent [19]

Genevray et al.

[11] Patent Number: 5,432,981

[45] Date of Patent: Jul. 18, 1995

[54] DEVICE FOR STRIPPING THE WEB OF FIBRES FROM THE DOFFER ROLLER IN A CARDING MACHINE

[75] Inventors: Henri Genevray, Guebwiller; Marc Brabant; Xavier Catry, both of Tourcoing, all of France

[73] Assignee: Thibeau, France

[21] Appl. No.: 227,601

[22] Filed: Apr. 14, 1994

[30] Foreign Application Priority Data

Apr. 15, 1993 [FR] France ..... 93 04445
Jan. 18, 1994 [FR] France ..... 94 00479

[51] Int. Cl.[6] ..... D01G 15/46
[52] U.S. Cl. ..... 19/106 R
[58] Field of Search ..... 19/98, 106 R, 106 A

[56] References Cited

U.S. PATENT DOCUMENTS

| | | | |
|---|---|---|---|
| 1,683,812 | 9/1928 | Walsh . | |
| 3,725,975 | 4/1973 | Varga et al. | 19/106 R |
| 4,099,295 | 7/1978 | Pickles | 19/106 R |
| 4,352,223 | 10/1982 | Felix et al. | 19/106 R X |
| 4,884,320 | 12/1989 | Gasser et al. | 19/106 R |

FOREIGN PATENT DOCUMENTS

| | | | |
|---|---|---|---|
| 1333809 | 5/1962 | France . | |
| 2136949 | 12/1972 | France | 19/106 R |
| 2364262 | 6/1975 | Germany | 19/106 R |
| 042292 | 9/1985 | Japan | 19/106 R |
| 1120222 | 7/1968 | United Kingdom . | |
| 1294654 | 11/1972 | United Kingdom . | |

*Primary Examiner*—John J. Calvert
*Attorney, Agent, or Firm*—Renner, Kenner, Greive, Bobak, Taylor & Weber

[57] ABSTRACT

The device for stripping the web of fibres (2) from the doffer roller (1) in a carding machine which includes a fly comb (3) on the output side of the doffer roller is characterized in that it comprises a toothed roller (5) cooperative with the doffer roller (1) for the purpose of stripping the web (2) from the latter, the fly comb being cooperative with the toothed roller when starting up the carding machine for the purpose of stripping the web from the toothed roller, whereas, at high speed, the web directly leaves the toothed roller (5) without cooperating with the fly comb.

15 Claims, 1 Drawing Sheet

DEVICE FOR STRIPPING THE WEB OF FIBRES FROM THE DOFFER ROLLER IN A CARDING MACHINE

The present invention relates to carding machines, i.e. textile machines for producing a sheet of fibres or for producing a band or sliver of fibres from a sheet and more particularly relates to a device for stripping the web of fibres present on the doffer roller.

Heretofore a fly comb or a stripper roller was employed for stripping the web of fibres on the doffer roller.

The stripping system employing a fly comb operates correctly but has the drawback of not permitting high linear speeds of the web, the upper limit being on the order of 90 m/min. On the other hand, the system employing stripper rollers permits exceeding this limit speed but however has the following drawbacks: the web of fibres has a tendency to wind round at least one of these rollers, the web is imperfectly guided when starting up the machine for reaching these rollers, and the same stripping system cannot be employed for all fibres, in particular when it is necessary to work on highly oiled or dyed fibres.

An object of the invention is to overcome these drawbacks by providing a stripping device which permits operating at high speed, may be employed for all types of fibres, avoids the aforementioned winding round and provides a good guiding of the web of fibres.

To this end, the device according to the invention, which comprises a fly comb on the output side of the doffer roller, is characterized in that it comprises a toothed roller which is cooperative with the doffer roller for stripping the web therefrom, the fly comb being cooperative with said toothed roller when starting up the carding machine for the purpose of stripping the web, while, at high speed, the web directly leaves the toothed roller without cooperating with the fly comb.

In order to permit a good stripping of the web of fibres this toothed roller rotates in the same direction as the doffer roller.

Advantageously, the clothing of the stripping toothed roller is rigid and formed by triangular teeth, for example isosceles or equilateral triangular teeth.

According to another advantageous feature of the invention, applicable in the case where an output calendering roller on the output side of the toothed roller is provided, the distance between the axes of the toothed roller and the calendering roller is between 100 and 300 mm, and preferably 200 mm.

Figure 1:
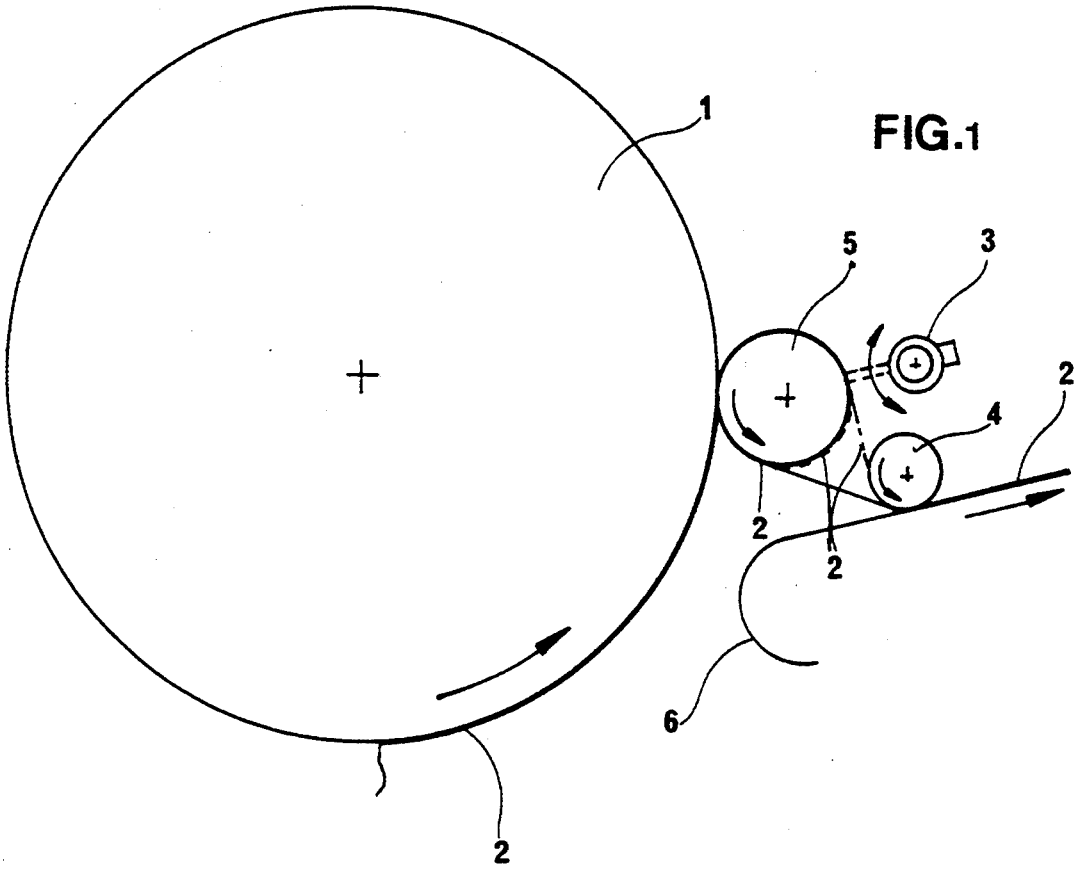
Figure 2:
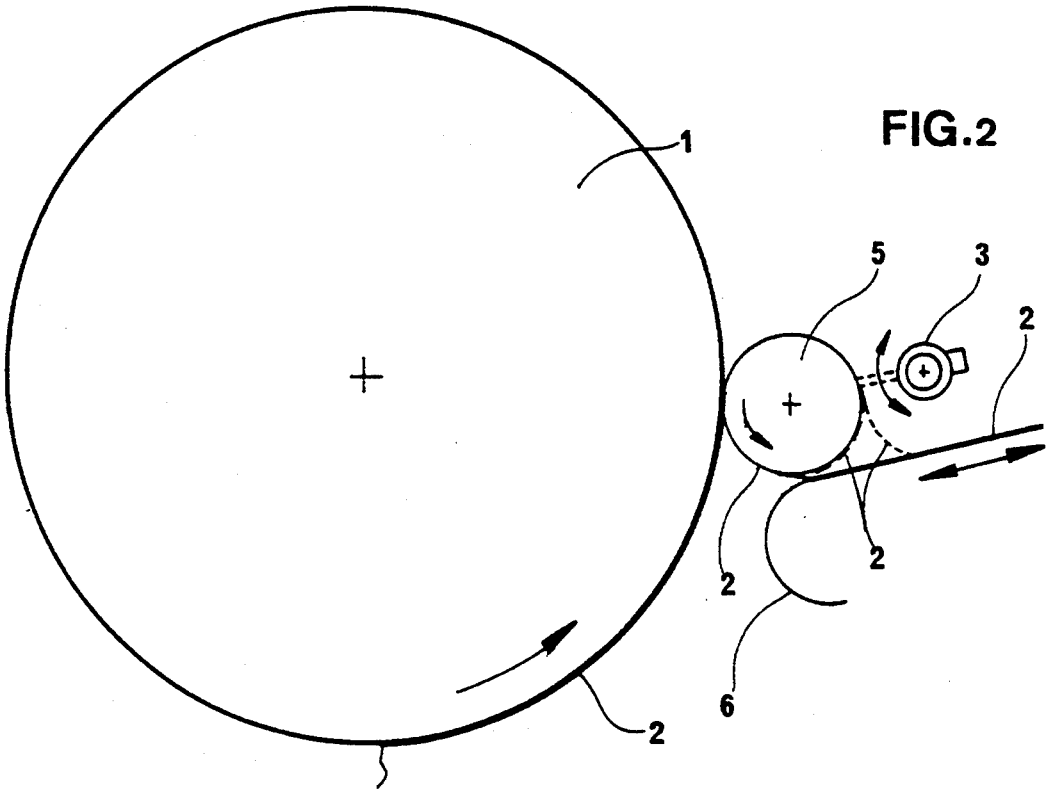

The invention will be well understood from the following description with reference to the accompanying drawing which is part of the disclosure and in which:

FIG. 1 is a diagrammatic side elevational view of a part of a carding machine equipped with the stripping device according to the invention in the case where a calendering roller is provided, and FIG. 2 is a similar view in the case where no calendering roller is provided.

Diagrammatically shown in the Figures is a part of a carding machine equipped with a stripping device according to two preferred embodiments of the invention. In FIG. 1, the carding machine comprises in the known manner a doffer roller 1 which receives a web of fibres 2 taken from a device (not shown) on the input side of the machine. In its output part, the carding machine comprises in the known manner a fly comb 3 followed by at least one output calendering roller 4, the latter directing the web 2 toward a collecting belt 6. The rollers 1 and 4 rotate in the same direction, for example in the counter-clockwise direction as shown in FIG. 1. On the other hand, the fly comb 3 undergoes an oscillating motion. According to the invention, for the purpose of stripping the web 2 present on the doffer roller 1 from the latter, a toothed roller 5 is provided which rotates in the same direction as the doffer roller 1 and is cooperative tangentially with the latter for stripping the web 2. The toothed roller 5 is preferably provided with a clothing having rigid metal teeth (not shown), the teeth having a triangular shape, for example an isosceles or equilateral triangular shape.

In operation, when starting up the carding machine, the rollers 1, 5 and 4 rotate at low speed and the web 2, as shown in dashed lines, first stays on the toothed roller 5 until it reaches the zone of action of the fly comb 3 which strips the web 2 from the toothed roller 5 and directs the web to the calendering roller 4. As the carding machine accelerates, the web 2 has a tendency to leave directly the toothed roller 5 and reach the calendering roller 4 so that the fly comb 3 no longer has any function apart from a safety function by returning the web 2 to its correct position if the web deviates from its normal path.

In such a device, the fly comb 3 is therefore only operative at the low speeds of operation of the carding machine for which it is particularly effective, whereas, at a high speed of operation of the carding machine, the web 2 passes directly from the toothed roller 5 to the calendering roller 4.

Owing to the fact that the web 2 is stripped from the doffer roller 1 by a roller, the carding machine can be made to operate at high speed irrespective of the treated fibres, the web is well-guided and the aforementioned winding difficulties are avoided.

In practice, in order to ensure that the toothed roller 5 correctly cooperates with the web 2 and with the fly comb 3, and in order to ensure that the calendering roller 4 correctly cooperates with the web, each of the rollers 4 and 5 has a diameter which exceeds a lower limit value; it is considered that each of these two rollers must have a diameter exceeding about 60 to 80 mm, although this is not imperative. Further, the two rollers 4 and 5 must not be too close to each other owing to the risk of a fouling of the calendering roller 4 and consequently the risk of a winding of the web or of the fibres onto the calendering roller. On the other hand, these two rollers must not be spaced too far apart in order to ensure a good control of the web and ensure that the latter is not disturbed on the edges which would result in a reduction in the limit speed of the system.

Consequently, according to an advantageous feature of the invention, it is considered that it is desirable, for normal values of the diameters of the two rollers 4 and 5, to arrange that the distance between the axis of the toothed roller 5 and the axis of the calendering roller 4 is between 100 and 300 mm and preferably 200 mm. In a practical embodiment of the device according to the invention, the toothed roller 5 has a diameter of about 160 mm, the calendering roller has a diameter of about 120 mm and the distance between the axes of these two rollers is 200 mm.

Shown in FIG. 2 is an alternative embodiment and application of the invention which differs from that of FIG. 1 only in respect of the elimination of the calendering roller 4, the web 2 consequently passing, at high speed, from the toothed roller 5 to the output converging means 6. At low speed, as before, the web is stripped from the toothed roller 5 by the fly comb 3 but is this time directed directly to the combing means. For the remainder of the construction, the embodiments shown in FIGS. 1 and 2 are similar so that no further description is necessary.

It must be understood that the scope of the invention is not intended to be limited to the described and illustrated embodiments, since various alternative embodiments may be envisaged without departing from the scope of the invention as defined in the claims.

What is claimed is:

1. A device for stripping a web of fibres from a rotating doffer roller in a carding machine, said device comprising a fly comb disposed on an output side of said doffer roller, a toothed roller having an axis and being cooperative with said doffer roller for stripping said web of fibres therefrom, output means for accepting and pulling said web from said toothed roller, said toothed roller being cooperative with said fly comb when starting up said carding machine for stripping said web of fibres from said toothed roller and directing said web to said output means, while, at high speed, said output means being cooperative with the toothed roller to pull said web of fibres directly from said toothed roller without cooperating with said fly comb.

2. A device according to claim 1, wherein the doffer roller rotates in a direction, and said toothed roller rotates in the same direction as the doffer roller.

3. A device according to claim 1, further comprising a clothing having triangular teeth disposed on said toothed roller.

4. A device according to claim 3, wherein said triangular teeth are isosceles triangular teeth.

5. A device according to claim 3, wherein said triangular teeth are equilateral triangular teeth.

6. A device according to claim 1, further comprising a clothing having rigid teeth disposed on said toothed roller.

7. A device according to claim 1, wherein said output means includes an output calendering roller disposed on the output side of said toothed roller, said output calendering roller having an axis disposed at a distance from said axis of said toothed roller, the distance between the axes of said toothed roller and said calendering roller being between 100 and 300 mm.

8. A device according to claim 7, wherein the distance between the axes of said toothed roller and said calendering roller is approximately 200 mm.

9. A device according to claim 7, wherein said toothed roller has a diameter of approximately 160 mm and said calendering roller has a diameter of approximately 120 mm.

10. A device according to claim 8, wherein said toothed roller has a diameter of approximately 160 mm and said calendering roller has a diameter of approximately 120 mm.

11. A device according to claim 1, wherein said output means includes an output converging device, said toothed roller being disposed between said doffer roller and said converging device, whereby said web of fibres comes directly from said toothed roller at high speed without cooperating with said fly comb.

12. A method of removing a web in a device provided at the discharge end of a carding machine having a rotating doffer roller, said device comprising a toothed roller cooperative with and rotating in an identical direction as said doffer roller for taking a web of fibres therefrom, output means disposed downstream for receiving said web, stripping means for stripping said web from said toothed roller and directing The web towards said output means, wherein the improvement comprises supplying an oscillatory fly comb for stripping said web from said roller such that said fly comb cooperates with said toothed roller when starting up said carding machine for stripping said web of fibres from said toothed roller and directing said web to said output means, while, at high speed, said output means pulls said web of fibres directly from said toothed roller without cooperating with said fly comb.

13. An apparatus for stripping a web of fibres from a rotating doffer roller in a carding machine, said apparatus comprising:

a toothed roller;

said toothed roller rotating on an axis in an identical direction as the doffer roller;

said toothed roller, in cooperation with the doffer roller, stripping the web of fibres therefrom;

a fly comb disposed on the output side of said toothed roller;

an output calendering roller mounted on an axis and disposed at a distance from and on the output side of said toothed roller;

said distance between the axes of said toothed roller and said calender roller being between 100 and 300 millimeters; and, said toothed roller being cooperative with said fly comb when starting up the carding machine for stripping the web of fibres from said toothed roller, while, at high speed, said output calendering roller cooperates with the toothed roller to pull the web of fibres directly from said toothed roller without cooperating with said fly comb.

14. An apparatus according to claim 13, wherein said distance between the axes of said toothed roller and said calendering roller is approximately 200 millimeters.

15. An apparatus according to claim 13, wherein said toothed roller has a diameter of approximately 160 millimeters; and, said calendering roller has a diameter of approximately 120 millimeters.

* * * * *